US012251644B2

(12) United States Patent
Sakai

(10) Patent No.: US 12,251,644 B2
(45) Date of Patent: Mar. 18, 2025

(54) FUSIBLE TOY BEAD

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 186 days.

(21) Appl. No.: 17/966,979

(22) Filed: Oct. 17, 2022

(65) Prior Publication Data

US 2023/0119099 A1 Apr. 20, 2023

(30) Foreign Application Priority Data

Oct. 18, 2021 (JP) ..... 2021-170484

(51) Int. Cl.
*A63H 33/00* (2006.01)
*A63H 33/10* (2006.01)
*B44C 3/12* (2006.01)

(52) U.S. Cl.
CPC ..... *A63H 33/001* (2013.01); *A63H 33/10* (2013.01)

(58) Field of Classification Search
CPC ..... A63H 33/00; A63H 33/001; A63H 33/10; A63H 33/14; A63H 33/22; A63H 33/06; B44C 3/12
USPC ..... 446/85, 87
See application file for complete search history.

(56) References Cited

U.S. PATENT DOCUMENTS

| | | | | |
|---|---|---|---|---|
| 6,416,853 | B1 * | 7/2002 | Nakashima | B44F 1/04 428/317.1 |
| 8,444,450 | B2 * | 5/2013 | Shibahashi | A63H 33/22 446/175 |
| 9,375,634 | B2 * | 6/2016 | Kamiyama | A63F 9/06 |
| 9,956,495 | B2 * | 5/2018 | Kamiyama | A63F 9/06 |
| 10,478,740 | B2 * | 11/2019 | Sakai | A63H 33/001 |
| 10,744,420 | B2 * | 8/2020 | Sakai | B44C 3/12 |
| 10,758,813 | B2 * | 9/2020 | Sakai | B44B 9/00 |
| 11,117,066 | B2 * | 9/2021 | Sakai | A63H 33/001 |
| 11,648,459 | B2 * | 5/2023 | Sakai | B44B 9/00 446/85 |
| 2002/0102905 | A1 * | 8/2002 | Tseng | A63H 33/046 446/131 |

(Continued)

FOREIGN PATENT DOCUMENTS

| | | |
|---|---|---|
| FR | 3 048 188 A1 | 9/2017 |
| FR | 3 076 467 A1 | 7/2019 |

(Continued)

OTHER PUBLICATIONS

GB Office Action issued Mar. 24, 2023 in Application No. GB2215131.0.

(Continued)

*Primary Examiner* — Alexander R Niconovich
(74) *Attorney, Agent, or Firm* — Faegre Drinker Biddle & Reath LLP

(57) ABSTRACT

The present invention relates to a fusible toy bead containing a pigment as a colorant and a water-soluble resin, in which the pigment contains a gold or silver pigment, and the fusible toy comprising at least one weld line formed on a surface of the bead. A total content of the gold or silver pigment may be 45 wt % or more with respect to a total content of the pigment, and the gold or silver pigment may be a pearl powder.

7 Claims, 3 Drawing Sheets

(56) References Cited

U.S. PATENT DOCUMENTS

| | | | | |
|---|---|---|---|---|
| 2007/0238815 | A1* | 10/2007 | Lee | B44C 3/06 524/109 |
| 2008/0011770 | A1* | 1/2008 | Tobias | B44B 9/00 221/189 |
| 2010/0248585 | A1* | 9/2010 | Nakashima | B44F 1/06 446/146 |
| 2013/0183881 | A1* | 7/2013 | Kamiyama | B44C 3/12 446/87 |
| 2017/0246551 | A1* | 8/2017 | Kamiyama | A63H 33/001 |
| 2019/0192961 | A1 | 6/2019 | Sakai | |
| 2019/0329144 | A1* | 10/2019 | Sakai | A63H 33/08 |
| 2019/0336880 | A1* | 11/2019 | Sakai | A63H 33/00 |
| 2020/0094131 | A1* | 3/2020 | Sakai | A63H 33/06 |
| 2021/0154972 | A1* | 5/2021 | Nakashima | B32B 27/10 |
| 2023/0218982 | A1* | 7/2023 | Sakai | A63F 9/06 446/87 |
| 2024/0246003 | A1* | 7/2024 | Sakai | A63H 33/001 |

FOREIGN PATENT DOCUMENTS

| | | | | | |
|---|---|---|---|---|---|
| GB | 2498410 | A | | 7/2013 | |
| GB | 2574712 | A | * | 12/2019 | A63H 33/00 |
| JP | 2004-204209 | A | | 7/2004 | |
| JP | 3131292 | U | | 4/2007 | |
| JP | 2011-139820 | A | | 7/2011 | |
| JP | 2020078687 | A | * | 5/2020 | A63F 9/06 |
| JP | 2021058721 | A | * | 4/2021 | A63F 9/06 |
| JP | 7082695 | B2 | * | 6/2022 | A63F 9/06 |
| KR | 1990-0001332 | A | | 2/1990 | |
| KR | 101968697 | B1 | | 4/2019 | |
| WO | WO-2016/191823 | A1 | | 12/2016 | |

OTHER PUBLICATIONS

Korean Office Action issued Apr. 22, 2024 in Application No. 10-2022-0132847.

French Search Report issued Mar. 11, 2024 in National Registration No. 2210738.

Korean Office Action issued Dec. 12, 2024 in Application No. 10-2022-0132847.

* cited by examiner

FUSIBLE TOY BEAD

CROSS-REFERENCE TO RELATED APPLICATIONS

This application is based on and claims priority under 35 USC 119 from Japanese Patent Application No. 2021-170484 filed on Oct. 18, 2021, the contents of which are incorporated herein by reference.

TECHNICAL FIELD

The present invention relates to a fusible toy bead.

BACKGROUND ART

Nowadays, there are toys called bead toys (toy beads) for people to play with by allowing beads, such as small spheres or cylindrical bodies made of a resin, to fuse together to produce various accessories and the like.

As the bead toy, there has been proposed a bead toy (fusible bead toy) in which granular beads or short cylindrical beads of various colors can be arranged in contact with one another so as to draw a relatively simple picture by beads, and the adjacent beads can fuse together by heating. Accordingly, a flat plate-shaped resin plate having a pattern by the beads of different colors or an accessory having a picture pattern depending on a shape of the arrangement of the beads is produced (see Patent Literature 1).

Patent Literature 1: JP2011-139820A

SUMMARY OF INVENTION

As for the toy bead described above, the beads of various colors are provided, and accessories having a picture pattern rich in color can be produced. The toy bead of this type may be required to have glossiness in order to produce a more glittering accessory.

An object of the present invention is to provide a fusible toy bead having glossiness and an excellent appearance.

A fusible toy bead according to an aspect of the present invention is a fusible toy bead containing a pigment as a colorant and a water-soluble resin, in which the pigment contains a gold or silver pigment.

According to this aspect of the present invention, a fusible toy bead having glossiness and an excellent appearance can be provided.

DESCRIPTION OF EMBODIMENTS

Figure 1:
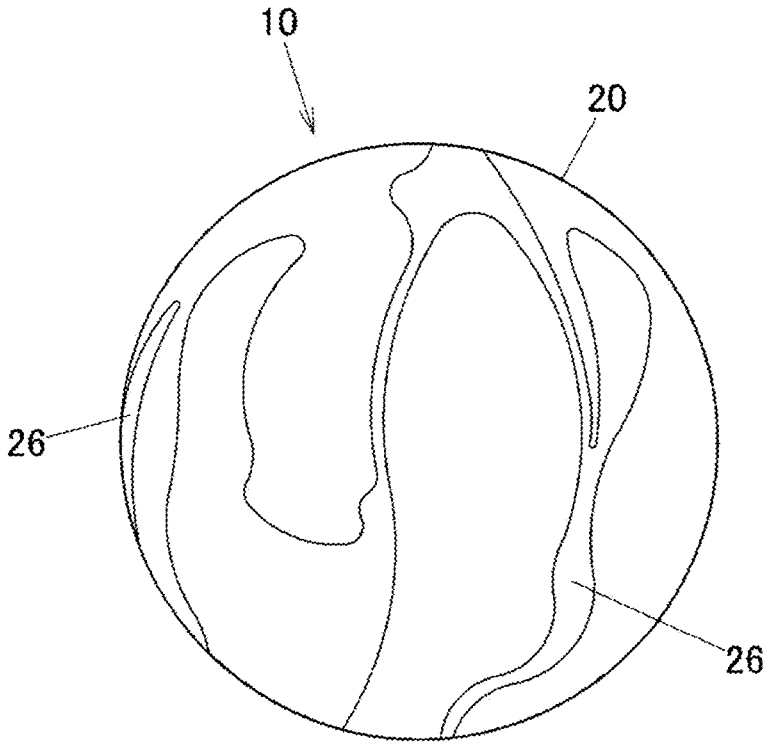
FIG. 1 is a front view illustrating an appearance of a fusible toy bead according to an embodiment.

An embodiment of the present invention will be described with reference to the drawings. As illustrated in FIG. 1, a fusible toy bead 10 according to the embodiment is composed of a substantially spherical bead 20 having a particle diameter of about 1 mm to 10 mm, preferably 3 mm to 7 mm, and usually around 5 mm. The bead 20 of the embodiment can be formed by injection molding using a mold. As a raw material of the bead 20, use can be made of a transparent synthetic resin colored by blending one or a plurality of pigments, which are colorants, with a water-soluble resin containing, for example, polyvinyl alcohol. When the bead 20 is colored with the colorants, the bead 20 can be colored transparent in colors such as green, blue, red, yellow, and purple as colors that harmonize transparency and the color.

The pigment as the colorant contains at least one of gold and silver pigments. Since the bead 20 contains the gold or silver pigment, the bead 20 has glossiness and an excellent appearance. The content of the gold or silver pigment is 45 wt % or more and may be 100 wt % with respect to a total weight of the pigment used in the formation of the bead 20. Such a range of content of the gold or silver pigment can effectively impart the glossiness to the bead 20. The size (particle diameter) of the gold or silver pigment is not particularly limited and can be, for example, 1 to 100 μm. The gold or silver pigment is preferably a gold or silver pearl powder. Two or more kinds of gold and silver pigments (gold and silver pearl powders) can be used in combination. For example, a gold pigment (gold pearl powder) and a silver pigment (silver pearl powder) can be used in combination, and a relatively fine pigment (pearl powder, having e.g., a particle diameter of 5 to 25 μm) and a relatively coarse pigment (pearl powder, having e.g., a particle diameter of 10 to 60 μm) can be used in combination. In the case where two or more kinds of the gold and/or silver pigments (gold and/or silver pearl powders) are used in combination, the total content of the gold and/or silver pigments (gold and/or silver pearl powders) may be 45 wt % or more with respect to the total weight of the pigment used in the formation of the bead 20.

Further, as illustrated in FIG. 1, a plurality of weld lines 26 is formed on a surface of the bead 20 of the embodiment due to the injection molding in a formation process. The weld line 26 can be formed intentionally (for example, by slowing down a speed of the injection molding) in the process of forming the bead 20. In the case where one or more weld lines 26 are formed in this way, since diffuse reflection of light occurs on surfaces of the weld line 26, the bead 20 that is better in the glossiness can be realized.

Since the beads 20 are formed of the water-soluble resin, the beads 20 can be dissolved in a wet state. That is, when the beads 20 are arranged in contact with one another and then, a liquid such as water is applied to the beads 20 or the beads 20 are immersed in a liquid such as water, the surfaces of the beads 20 can be dissolved. Thereafter, moisture on the surfaces of the beads 20 is evaporated and dried, so that the adjacent beads 20 can fuse together. Therefore, for example, after an illustration sheet on which a desired picture is drawn is fixed to a lower side of a tray, and the beads 20 of desired colors are placed on the tray in accordance with the picture, by keeping the beads 20 in a wet state and then drying the beads 20, it is possible to produce an accessory corresponding to the picture drawn on the illustration sheet.

Since the bead 20 has the glossiness, when the accessory described above is formed by using the bead 20, a glittering accessory having excellent glossiness can be realized. The accessory may be produced by combining the bead 20 having glossiness with other beads having no glossiness.

As described above, the fusible toy bead 10 according to the embodiment is formed by blending the pigment (pearl powder) containing at least one of gold and silver pearl powders as the colorant. Therefore, as compared with a conventional fusible toy bead of which an appearance deteriorates due to roughness of particles of a metal powder, particles exhibiting glossiness are fine, and the fusible toy bead 10 has more glittering glossiness and a better appearance. Therefore, the fusible toy bead 10 can exhibit more glittering glossiness depending on an angle of light emitted to the accessory assembled using the beads 20, and allows a user to play with the beads without getting bored.

Although the spherical bead 20 is illustrated in the present embodiment, the shape of the bead 20 is not limited. For example, other shapes such as a star shape and a polyhedral shape may be used. With the polyhedral shape, a surface gloss effect due to reflected light is increased, and the glittering fusible bead having a better appearance can be realized.

According to the embodiment of the present invention as described above, a fusible toy bead of the following aspect can be provided.

A fusible toy bead according to a first aspect is a fusible toy bead containing a pigment, which is colorant, and a water-soluble resin, in which the pigment contains a gold or silver pigment.

According to this configuration, it is possible to realize a fusible toy bead in which particles exhibiting glossiness are fine, and which exhibits glittering glossiness and is excellent in appearance as compared with a conventional fusible toy bead.

The fusible toy bead according to a second aspect, has at least one weld line formed on a surface of the bead.

According to this configuration, since diffuse reflection of light occurs on the surface of each weld line, it is possible to realize the fusible toy bead that exhibits much more glossiness due to a synergistic effect with the inclusion of a gold or silver pigment.

The fusible toy bead according to a third aspect, has a total content of the gold or silver pigment of 45 wt % or more with respect to the total content of the pigment.

According to this configuration, by increasing the content of the gold or silver pigment, it is possible to effectively impart glossiness to the fusible toy bead.

In the fusible toy bead according to a fourth aspect, the gold or silver pigment is a pearl powder.

According to this configuration, it is possible to provide a specific material for exhibiting glossiness as compared with a conventional fusible toy bead.

The embodiments described above have been presented by way of example only, and are not intended to limit the scope of the inventions. These novel embodiments can be implemented in various other forms, and various omissions, replacements, and modifications can be made without departing from the gist of the invention. These embodiments and a modification thereof are included in the scope of the invention or the gist thereof, and are included in a scope equivalent to the invention described in the claims.

EXAMPLES

In Examples, fusible toy beads of 12 colors having glossiness were produced. Gold, silver (coarse), and silver (fine) pearl powders were used as the pearl powders for imparting glossiness. Blending amounts of colorants and contents of the pearl powders in each color are shown in Table 1. In Table 1, titanium dioxide is contained to develop whiteness, gold is pearl powder of gold particles having particle diameters of 5 to 25 μm, silver (coarse) is pearl powder of coarse silver particles having particle diameters of 10 to 60 μm, and silver (fine) is pearl powder of fine silver particles having particle diameters of 5 to 25 μm. In Table 1, a unit of the blending amount of each colorant is g (gram), and a unit of the contents of the pearl powders, that is, the contents of gold, silver (coarse), and silver (fine) in the total of the colorants is wt %.

TABLE 1

| Color | Red No. 3 | Blue No. 1 | Blue No. 2 | Yellow No. 4 | Yellow No. 5 | Titanium dioxide (titanium white) | Black | Gold | Silver (coarse) | Silver (fine) | Content of pearl powder (w %) |
|---|---|---|---|---|---|---|---|---|---|---|---|
| Metallic blue | 0.8 | 10.0 | 28.0 | | | | | | 60.0 | | 60.7 |
| Metallic purple | 4.0 | | 10.0 | | | | | | 60.0 | | 81.1 |
| Metallic light blue | | 2.6 | 2.8 | 0.8 | | 2.4 | | | | 90.0 | 91.2 |
| Metallic red | 46.0 | | | | 24.0 | | 2.8 | | | 60.0 | 45.2 |
| Metallic copper | 1.0 | | | | 14.0 | | 2.0 | | 80.0 | 1.0 | 82.5 |
| Metallic gold | | | | 12.0 | 0.8 | | | 280.0 | 60.0 | | 96.4 |
| Metallic green | | 9.0 | | 12.0 | | | | | 60.0 | | 74.1 |
| Metallic black | | | | | | | 100.0 | | 100.0 | | 50.0 |
| Metallic yellow | | | | 7.0 | | | | 40.0 | 80.0 | | 94.5 |
| Metallic brown | 0.2 | | | | 20.0 | | 8.0 | | | 60.0 | 68.0 |
| Metallic white | | | | | | 32.0 | 1.2 | | | 360.0 | 91.6 |
| Metallic silver | | | | | | 12.0 | 22.0 | | 320.0 | | 90.4 |

In the preparation of the beads, first, each colorant containing the pearl powder was dissolved in a mixed solution obtained by mixing a trace amount of glycerin and a small amount of stearic acid with polyvinyl alcohol (PVA) as a solvent. Next, the solution was injected into a mold, and a molded product of the spherical bead was produced by injection molding. After the injection molding, the molded product was separated from a runner portion of the mold and temporarily stored under ultraviolet light shielding. In the injection molding, the solution was introduced and injected into the mold intentionally at a speed slower than a standard speed such that a plurality of weld lines was formed on a surface of the bead.

The injection molding conditions were as follows: molding temperature in a range of 175 to 190° C. and injection pressure in a range of 30 to 100 kgf/cm$^2$ (or MPa). Further, injection speed was in a range of 25 to 40 mm/sec, and molding cycle was 28 sec/shot. Cold water was used as cooling water. For these conditions, the molding temperature was set to a temperature higher by about 5° C., the injection pressure was set to a pressure higher by about 5 kgf/cm$^2$, the injection speed was set to a speed lower by about 5 mm/sec, and the molding cycle was set to a speed lower by about 2 to 3 sec/shot as compared with production conditions of a non-glossy homologous bead.

Figure 2:
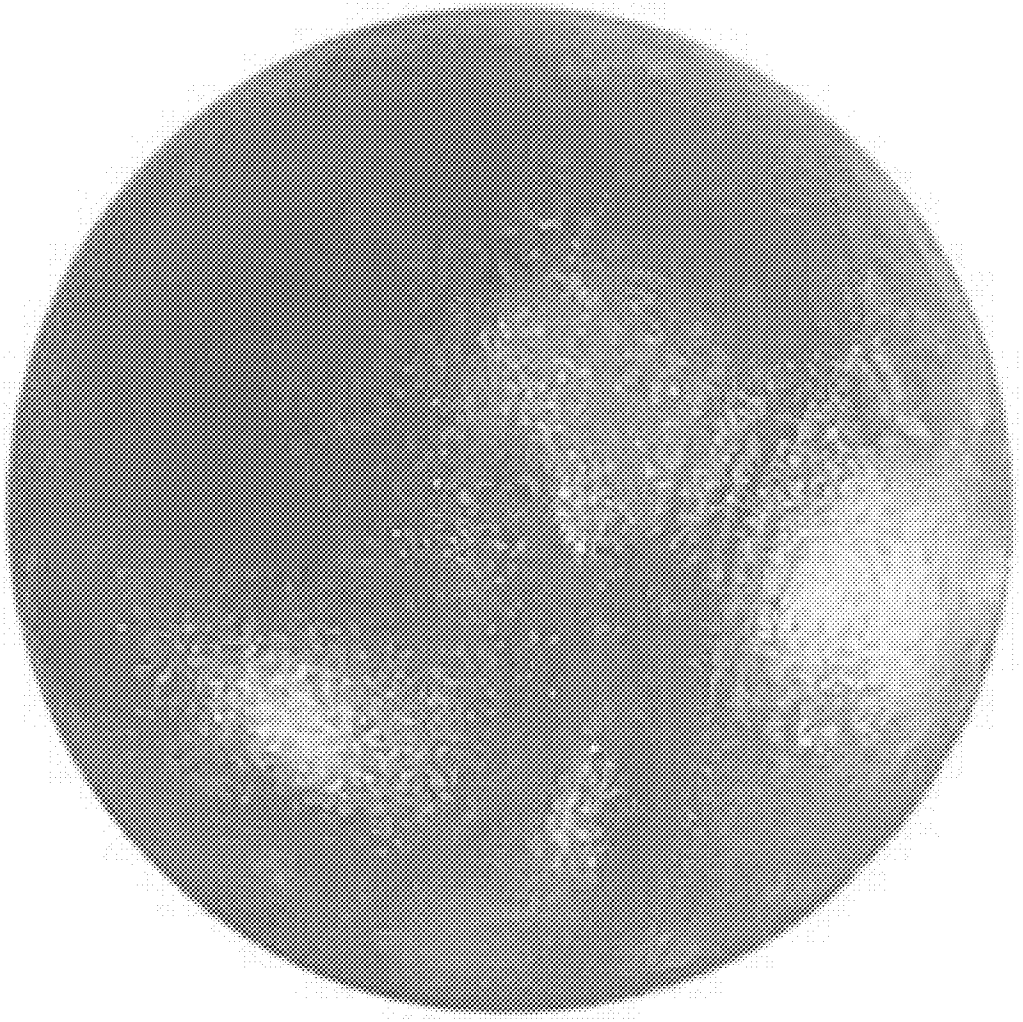
FIG. 2 is a photograph showing an appearance of a fusible toy bead of metallic light blue produced in the Example.
Figure 3:
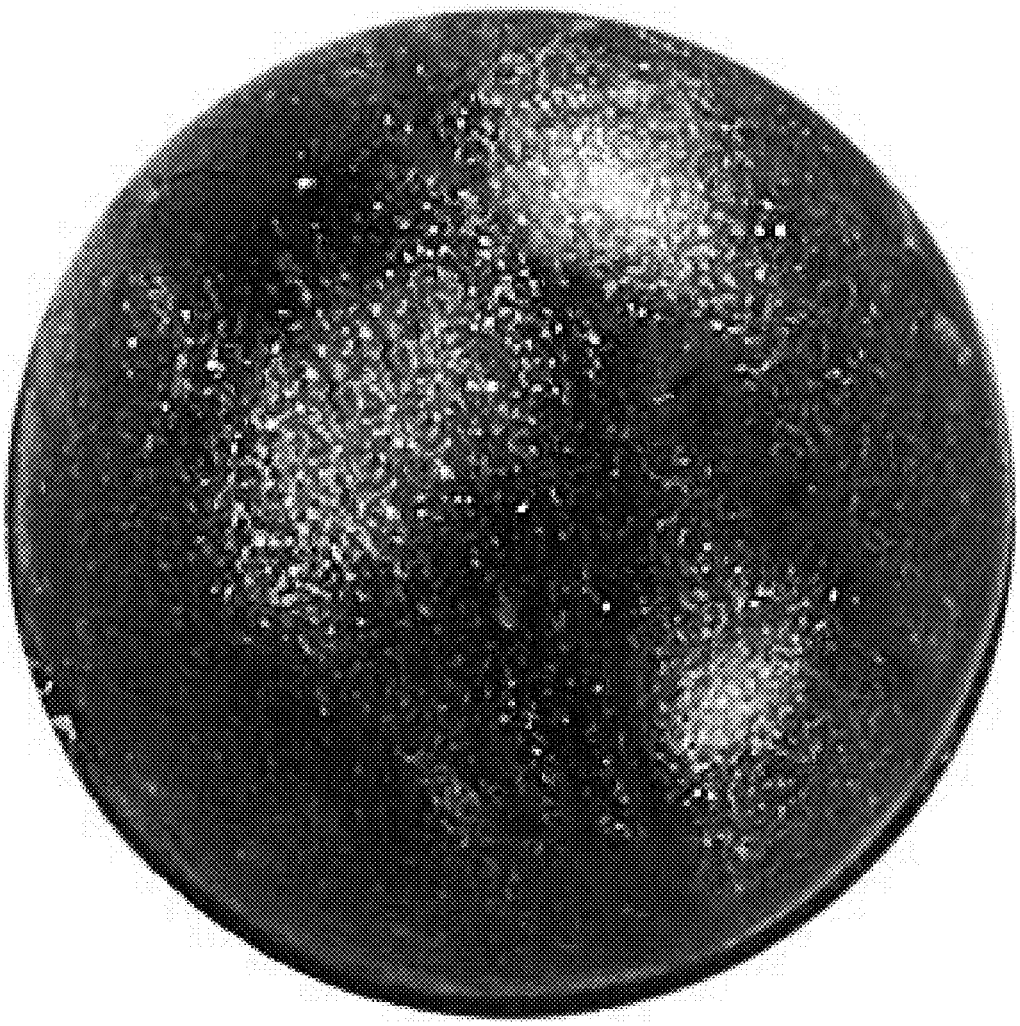
FIG. 3 is a photograph showing an appearance of a fusible toy bead of metallic black produced in the Example.

The surfaces of the produced beads of 12 colors were visually observed. Among the produced beads of 12 colors, FIG. 2 shows an appearance photograph of metallic light blue (light blue), and FIG. 3 shows an appearance photograph of metallic black (black). As shown in FIG. 2 and FIG. 3, weld lines (black stripe pattern portions in the photographs) were observed on surfaces of both beads, and glossiness was also observed. Similarly, the plurality of weld lines can be confirmed on the surfaces of all the produced beads, and it can be confirmed that the beads have glossiness.

REFERENCE NUMERALS AND SIGNS

10 Fusible toy bead
20 Bead
26 Weld line

What is claimed is:

1. A fusible toy bead comprising:
a pigment as a colorant, and
a water-soluble resin,
wherein the pigment comprises a gold or silver pigment, and
the fusible toy comprising at least one weld line formed on a surface of the bead.

2. The fusible toy bead according to claim 1, wherein the fusible toy having a total content of the gold or silver pigment being 45 wt % or more with respect to a total content of the pigment.

3. The fusible toy bead according to claim 1, wherein the gold or silver pigment is a pearl powder.

4. The fusible toy bead according to claim 1, wherein the water-soluble resin comprises a polyvinyl alcohol.

5. The fusible toy bead according to claim 1, wherein the fusible toy having a particle diameter of 1 to 10 mm.

6. The fusible toy bead according to claim 1, wherein the gold or silver pigment has a particle diameter of 1 to 100 μm.

7. The fusible toy bead according to claim 1, wherein the fusible toy having a substantially spherical shape.

* * * * *